US007069816B1

(12) United States Patent
Saathoff et al.

(10) Patent No.: US 7,069,816 B1
(45) Date of Patent: Jul. 4, 2006

(54) MOTOR-DRIVEN SCREW DRIVER

(75) Inventors: Konstanze Saathoff, Hasbergen (DE); Achim Lübbering, Herzebrock (DE)

(73) Assignee: Johannes Luebbering AG, Baar (CH)

( * ) Notice: Subject to any disclaimer, the term of this patent is extended or adjusted under 35 U.S.C. 154(b) by 504 days.

(21) Appl. No.: 09/554,343

(22) PCT Filed: Sep. 14, 1999

(86) PCT No.: PCT/DE99/02906

§ 371 (c)(1),
(2), (4) Date: Dec. 6, 2000

(87) PCT Pub. No.: WO00/15393

PCT Pub. Date: Mar. 23, 2000

(30) Foreign Application Priority Data

| | | |
|---|---|---|
| Sep. 14, 1998 | (DE) | 198 41 870 |
| May 5, 1999 | (DE) | 299 08 022 U |
| May 5, 1999 | (DE) | 299 08 023 U |
| Jun. 19, 1999 | (DE) | 299 10 742 U |

(51) Int. Cl.
*B25B 17/00* (2006.01)

(52) U.S. Cl. ..... 81/57.13; 81/58.1

(58) Field of Classification Search ..... 81/57.13, 81/57.29, 58.1
See application file for complete search history.

(56) References Cited

U.S. PATENT DOCUMENTS

| | | | | |
|---|---|---|---|---|
| 2,512,032 A | | 6/1950 | Mellert | |
| 2,792,733 A | | 5/1957 | Walraven et al. | |
| 3,369,421 A | | 2/1968 | Short et al. | 74/421 |
| 3,581,606 A | | 6/1971 | Grabovac | |
| 3,596,718 A | | 8/1971 | Fish et al. | 173/12 |
| 3,646,837 A | | 3/1972 | Reynolds | 81/10 |
| 3,701,295 A | | 10/1972 | Mende | |
| 3,733,935 A | * | 5/1973 | Tsuji | 81/58.1 |
| 3,939,924 A | * | 2/1976 | Grabovac | 81/58.1 |
| 3,987,692 A | | 10/1976 | Lesner et al. | 81/57.13 |
| 4,060,137 A | | 11/1977 | Bickford et al. | 173/12 |
| 4,248,107 A | | 2/1981 | Blattner | 81/483 |
| 4,287,795 A | | 9/1981 | Curtiss | 81/57.26 |
| 4,524,649 A | | 6/1985 | Diaz et al. | 81/57.13 |
| 4,974,475 A | | 12/1990 | Lord et al. | 81/57.13 |
| 4,993,288 A | | 2/1991 | Anderson et al. | 81/57.39 |

FOREIGN PATENT DOCUMENTS

| | | |
|---|---|---|
| DE | 1 871 193 | 4/1963 |
| DE | 2020503 | 1/1971 |
| DE | 26 26 493 | 6/1973 |
| DE | 25 20 250 A1 | 5/1975 |
| DE | 43 42 464 A1 | 6/1995 |
| DE | 296 18 817 U1 | 10/1996 |
| DE | 199 38 707 C2 | 8/1999 |
| DE | 100 23 857 A1 | 5/2000 |

* cited by examiner

*Primary Examiner*—Debra S. Meislin
(74) *Attorney, Agent, or Firm*—Greenblum & Bernstein, P.L.C.

(57) ABSTRACT

The invention relates to a motor-driven screw driver comprising a drive motor to which a first torque limiter is assigned and a head (1) which presents the screw-driving tool or a recess for a screw-driving tool. A ratchet mechanism (6) and a torque limiter (5) assigned to said ratchet mechanism (6) are positioned in the head (1) in such a way that the screw driver forms a manually actuated torque wrench whose torque is defined by the torque limiter (5).

20 Claims, 1 Drawing Sheet

MOTOR-DRIVEN SCREW DRIVER

BACKGROUND OF THE INVENTION

Said wrenches are used, for example, in the automotive field, especially in manufacturing plants but also in repair shops. In practice, manual devices are designated manual wrenches even though said devices are motor-driven. Said devices are designated hereafter as rod-type wrenches when they have a rod-shaped housing; they are designated pistol-type wrenches when their housing is of an offset design.

The drive means is usually electricity or compressed air. With electric devices, the motors are usually supplied with electric power from a central source via a connecting cord, or in a decentralized manner from a storage battery; however, wrenches with other types of power supply, e.g. battery, capacitor, or other electrical storage means are conceivable.

Based on a possibly existing pneumatic or electrical power connection, said wrench then has an actuating grip, then a motor and gear means connected to it, usually a planetary gear means, and connected to said gear means a clutch to which the freely terminating end section of the wrench designated the "head" is attached, said head conceivably being designed as straight or—especially with rod-type wrenches—as an angle head. In practice, said rod-type wrenches with angle heads are frequently no longer designated rod-type wrenches but "offset wrenches." A head is designated an angle head when its drive shaft is offset relative to the output shaft, frequently at an angle of 90°. At the free end of the head, the output shaft is usually designed square so that attaching sockets with the desired wrench size for driving may be attached.

In practice, it has proven advantageous to design said heads as separate components since they are the first component group of the wrench to wear out, especially when they are designed as angle heads, making fast and inexpensive repairs to the wrench feasible simply by replacing the head. Additionally, said replaceable heads offer the advantage of arranging various head designs attaching to the actual base unit of the wrench so as to ensure optimum accessibility of the screwing location.

Safety-relevant screwing locations, e.g. in the area of the steering or brake systems, are usually implemented in a two-step tightening process: First a driving operation of approximately 80% to 90% of the target tightening torque is performed as quickly as possible, followed by a relatively slow further tightening of the bolt. The load release between these two steps during tightening takes into account the settling behavior of the screwing location and ensures especially reliable adherence to the desired target or nominal torque from the tightening torque actually achieved during the driving operation.

The initial fast tightening during said two-step driving operation is usually performed by motor by means of said manual wrench. The end of this motorized initial tightening of the bolt is reached by a torque limiter which is either directly incorporated into the manual wrench, or, in the case of pneumatic so-called "choke-type" wrenches, the maximum torque to be applied can be limited by the air pressure with which the tool is driven so that here the torque limiter attached to the drive motor is implemented outside the actual tool.

Subsequently, the worker must use a second device, i.e. a hand-actuated torque wrench, since the motorized manual wrench cannot ensure the required precision needed to maintain the tightening torque. The torque wrench has the required precision so that, within the range of specified tolerances, the torque wrench releases precisely at the preset nominal torque, for example, by means of an articulated mechanism, such that a clearly audible clicking and a certain amount of backlash of the torque wrench is generated which indicates that the correct tightening torque has been obtained. From practical use, torque wrenches are known which are adjustable or which release at the torque permanently preset at the factory. DE AS 21 06 263 also shows a torque wrench designed as an articulated wrench.

A motor-driven, hand-held wrench is known from U.S. Pat. No. 4,060,137, which wrench has means for torque limitation and the possible automatic shutoff of the wrench when a preset torque is achieved. This principle of this wrench is based on the design of the pistol-type wrench, with the components known from a pistol-type wrench, however, forming almost exclusively the grip area of a considerably larger, roughly flatiron-shaped, large housing. Said wrench does not have a freely terminating "head" in the aforementioned sense; rather, connected to the drive unit are gear means which in turn lead to the grip and the connection for the compressed-air supply provided therein. There is no provision for operating the wrench without the motor drive. The release precision of the pneumatic torque limiter is possibly insufficient for many safety-related screwing locations.

From practical use, a manually operated torque wrench from the Tohnichi Company is also known to which a air motor is attached and which consequently is not designated by the manufacturer or the distributor of these tools as a motorized manual wrench but instead as a torque wrench ("torque wrench with air motor"). Said torque wrench first permits the motorized tightening of the screw connection, the otherwise unmodified torque wrench being subsequently employed in the usual known manner. The manipulation of this device is arduous since it has comparatively large dimensions due to the attached compressed-air motor and thus poor accessibility to restricted screwing locations. Manipulation is further impaired by the fact that the relatively high weight of the air motor lies outside the longitudinal axis of the torque wrench such that the user must constantly compensate for this eccentricity by a correspondingly tighter, tiring grip in order to avoid unwanted tilting motions of the tool around its longitudinal axis.

DE 25 20 250 A1 and DE 296 18 817 U1 each show a wrench with a torque limiter and ratchet drive, said devices being the only torque limiters provided on the wrench.

The object of the invention is to create a motor-driven manual wrench which allows for speedy work and the quick implementation of a driving operation, even with two-step tightening.

SUMMARY OF THE INVENTION

The invention proposes in other words to combine the motor drive normally provided in the manual wrench with an additional ratchet drive containing its own torque limiter as they are provided in torque wrenches. In general, the designation "ratchet drive" means any drive means which permits transmission of a driving torque in one direction of rotation and which moves freely in the opposite direction, e.g. a ring gear with locking mechanism which permits fixing or guiding in one direction, said ratchet drive often being designated a freewheel in the art.

The proposal according to the invention achieves the following object: After the manual wrench is placed on the bolt, the bolt can be gripped by the motor-driven manual wrench until the latter's torque limiter releases, and subsequently, with no requirement of by now having the grip of the wrench function as the grip for the torque wrench, and allowing the two work steps "gripping the bolt" and "checking the bolt" to be performed by one person in one step without changing tools; i.e. actuation of the torque wrench is not performed by the motor drive but by the purely manual actuation of the wrench until the torque limiter located in the head and connected to the ratchet drive releases.

The two torque limiters, first for the motorized and second for the manual use of the manual wrench, are typically set for different values so that screwing locations with two different obtainable torques, and correspondingly two-step tightened screwing locations, are possible without having to adjust or modify the manual wrench.

When mention is made below without further explanation of a "torque limiter," it is understood that the additional torque limiter in the head of the manual wrench is always referred to, while the first torque limiter attached to the motor drive of the manual wrench is viewed either as an integral, already present component of the manual wrench or as an external device such as the compressed air supplied to a pneumatic choke-type wrench.

A torque wrench constituting the manually actuated manual wrench may be designed in the known manner as an articulated wrench or as a bending bar, where mechanical monitoring is performed when the torque wrench is designed as an articulated wrench while electronic monitoring may be provided when the torque wrench is designed as a bending bar.

The target or nominal torque at which the torque limiter releases is usually higher than the shutoff torque of the motor-driven wrench. In this way, the two-step driving operation can be performed by first having the off switch already provided in the wrench, as is common on motor-driven wrenches, release at a specified torque which may correspond to about 80% to 90% of the target torque. In an electrically powered manual wrench, this can be performed by a sensor which shuts off the motor.

Subsequent to this first tightening or driving step, the wrench may be used as a non-motorized but manually operated wrench like a torque wrench until the torque limiter during this second tightening or driving step releases at 100% of the preset target tightening torque which is set not on the actual wrench but on the torque limiter. This setting can be permanently specified and thus immune to manipulation; however, it may be advantageous to provide adjustability by the user so that the manual wrench may be easily adapted to differing driving conditions.

The proposed manual wrench considerably simplifies the work sequence since the user does not have to continually manipulate two different devices. By avoiding having to continually lay aside the motorized manual wrench with its relatively sensitive mechanism to pick up a torque wrench, an additional effect is that the comparatively expensive and sensitive tool is used more sparingly and its life therefore extended.

According to the invention, the torque limiter and ratchet drive are both located in the head of the wrench. In this way, a compact assembly is created in which the individual functional parts are optimally adjusted and matched to each other.

In particular, if the head is replaceably mounted on the rest of the wrench, the known advantages of a replaceable head are achieved. In particular, this approach allows the base units of existing wrenches to be retrofitted with heads designed according to the invention so that in a comparatively inexpensive way, manual wrenches may be equipped according to the invention with the additional function of a torque wrench.

An adapter may be advantageously provided which at one end connects to a standardized drive shaft of the head, and at the other end—depending on the base unit used—has a connector adapted to its output shaft. This approach allows for inexpensive manufacture of the heads designed according to the invention in large production runs, while enabling adaptation to a multiplicity of different wrench types in a similarly inexpensive way by using suitable adapters. In particular, provision can be made to design the drive shaft of the head without adapters as well for connection to a predetermined type of output shaft so that wrenches with said output shaft may be provided with the head designed according to the invention without using an adapter.

The torque limiter may be designed advantageously as an articulated element in known fashion so that by bending, reaching the target torque is displayed to the user and —except for the mentioned facilitation—the wrench may be manipulated in the manner familiar to the user without relearning the procedure.

On traditional articulated elements, the pivotably mounted support is pivotably mountable in the area of the tool shaft. The axis to be limited in terms of the transmittable torque is located at a distance from this position. In contrast to this approach, in the proposed manual wrench a lever arm between these two pivoting or rotating axes is advantageously obviated by mounting the articulated element such that the pivotable support present in such articulated elements, which support tensions the actual articulated body against a second support, is mounted to pivot around that axis, which axis simultaneously is also the axis for which the transmittable torque is to be limited. This approach ensures that the manner in which the user grasps the tool can have no effect on the shutoff torque of the torque limiter, thereby improving the precision of the shutoff torque since it is dependent only on the design conditions of the tool and not on the manipulation of the tool.

Provision may also be made advantageously for a visual display which is activated when the specified target tightening torque is obtained. It is especially simple, functionally reliable, and inexpensive to provide that the display be activated mechanically, for example, by changing color in a view window on the wrench, or by an axially movable pin, a pivotably movably mounted bar, or a similar approach.

As an alternative to or supplemental to said mechanical displays, an electrical sensor may be provided which generates a signal when the specified target tightening torque is obtained. Said signals may be sent by wire or wirelessly, e.g. via radio, for example, to a central control unit located remotely from the manual wrench, which control unit can record the number of driving operations and/or the level of the tightening torques, or at minimum, the achievement of the specified target torque.

Said signals from the electronic sensor may, however, also be evaluated at the manual wrench itself by an electronic circuit which, for example, triggers acoustic or optical signals by electrical means, for example, by a pilot light or by a high-frequency signal tone when, for example, the specified tightening torque is obtained.

As an alternative to or supplemental to said display, the electrical signals of the sensor may also be evaluated by the electrical circuit so as to activate said visual and/or acoustic display after a specified number of correctly implemented driving operations. In this manner, the worker may be provided in a supporting way with a functional check of his work. For example, when wheels are bolted on by means of five bolts, the display can be activated after each implementation of the five correct bolting operations. Thus it is possible for the worker simply and reliably to monitor his work by the fact that after each wheel has been properly bolted, the acknowledgment signal or visual display appears.

The mechanical or electrical, visual, or acoustic display may be advantageously provided in the head of the manual wrench. As a result, not only is said display located optimally within the visual and audible range of the worker, but in this way the head designed according to the invention can have especially advantageously all advantageous functions and display options such that an especially simple retrofit of existing manual wrenches becomes possible, or an especially simple repair of manual wrenches is facilitated by the fact that the head having all functions may be replaced completely.

If the manual wrench is designed with an elongate housing as a rod-type wrench, manipulation of the manual wrench is simplified as compared with the aforementioned pistol-type wrenches since its design is similar to that of commercially available likewise rod-type torque wrenches and a correspondingly familiar manipulation is facilitated.

In particular, when said rod-type wrench is provided with an angle head, simple and efficient manipulation of the wrench, both initially as a motorized wrench and subsequently as a torque wrench, becomes possible requiring the least possible use of force by the user, said user being able to maintain his grip on the wrench, i.e. without having to shift the position of the manual wrench or manipulate it in some other manner.

The easy access to difficult-to-access screwing locations may be facilitated by the use of a flat output means located on the head of the wrench. This may be accomplished in a known manner by attachment to the output shaft of the wrench or of the angle head so that, depending on the situation, the flat output means may be used or removed from the manual wrench. Alternatively, it is possible to integrate said flat output means directly into the head to achieve especially compact dimensions for the tool. In this regard, a flat output means may be provided advantageously, e.g. to facilitate driving bolts on pipes.

Commercially available battery-powered wrenches are employed especially for driving operations in motor vehicle interiors. They are designed, for example, to transmit rotary torques of up to a maximum of 15 Nm. To facilitate easy manipulatability here, the housing is designed to consist of lightweight material, usually plastic. The housing of the proposed manual wrench can be advantageously designed to be considerably more bend-resistant than known housings since the housing not only must fulfill a protective function for the motor drive unit of the manual wrench, but must also withstand the forces to be transmitted manually.

The grip of the manual wrench is advantageously designed not only for operating the drive motor, for example, provided with a power switch, but the grip area is also designed such that the entire manual wrench may be manipulated like a purely manually operated wrench.

Due to the especially bending-resistant housing, the transmission of high tightening torques is possible at which traditional motorized manual wrenches would be destroyed, for example, levels 2 times or even over 10 times the torque to be applied by the motor. Due to this design of a battery-powered manual wrench, tightening torques of 40 Nm, 50 Nm, 100 Nm, or even higher than 150 Nm are possible compared with the traditional 15 Nm.

The housing may consist of plastic, especially a fiber-reinforced plastic, to ensure the desired bending strength of the housing. However, the housing may preferably consist of metal, here preferably of a light metal to ensure fatigue-free manipulation.

The following describes an embodiment of the invention based on the drawing.

DESCRIPTION OF ILLUSTRATED EMBODIMENT

Figure 1:
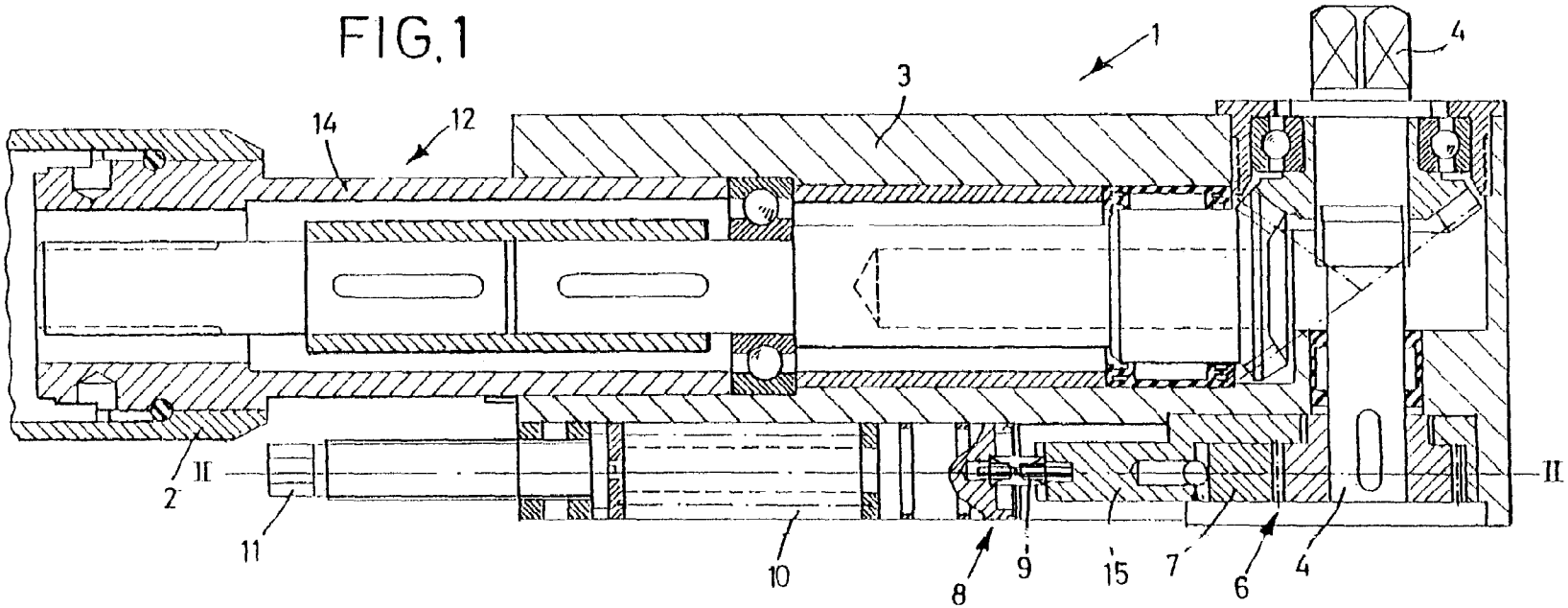
FIG. 1 shows a cross section of the head area of a manual wrench.

In the drawing, 1 generally refers to a head of a manual wrench. Head 1 is designed as an angle head and attached to a rod-shaped housing of a so-called rod-type wrench; the housing is made of a lightweight metal alloy which provides the high bending strength of the housing. The rod-type wrench contains a complete drive unit with a power storage means or a connection for a power supply, a drive motor, a power switch for the drive motor, and an integral torque limiter which limits the torque that can be transmitted by the motor to the output shaft of the drive unit in known fashion, e.g. by switching off the motor in the case of an electric motor, by partially or completely bypassing the driving air in the case of a compressed-air motor, or in a similar manner. Rod-type wrenches are themselves well known so that for the sake of clarity only the end of shaft 2 of the rod-type wrench is visible in the drawing.

Head 1 has a housing 3 in which a known angled arrangement for a power offset drive is provided. An output shaft 4 is provided at head 1, the free end of said shaft being square and serving to accommodate attaching sockets.

Figure 2:
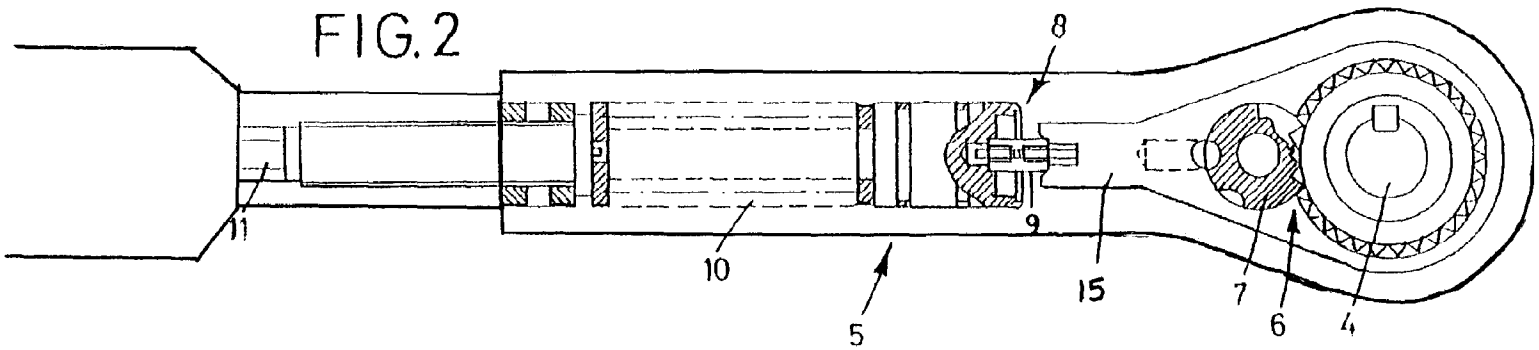
FIG. 2 shows a sectional view along line 11-11 in FIG. 1.

The output shaft 4 is extended to the rear and may be of one-piece or multi-piece design. It extends from and beyond the actual housing 3 of head 1 and extends up to a torque limiter 5 visible especially in FIG. 2. Said torque limiter is designed as a so-called articulated wrench in a manner similar to a basically known torque limiter. Said torque limiter has a ratchet drive 6 with a change-over switch 7 for selecting the working direction of torque transmission, and said torque limiter has an articulated joint 8 whose articulated body 9 is gripped between a first support by an indicated spring 10 and a second support 15. Spring 10 may be released or tensioned by a setscrew 11 so that the pretensioning of articulated joint 8 is adjustable, and as is the torque at which the articulation of articulated joint 8 occurs.

Support 15 is mounted to pivot around a pivot axis that coincides with the axis of output shaft 4. Articulated body 9 can perform the articulating motion through the pivotal motion of said support 15. Because the pivot axis of support 15 coincides with output shaft 4 limited in its transmitted torque, a lever arm between a pivot axis of support 15 and this torque-limited shaft is obviated.

Such a lever arm would cause the shutoff torque of torque limiter 5 to be influenceable by the fact that the manual wrench is gripped a different places along its shaft, and by the fact that the user could apply leverage between the ball of the thumb and the thumb, thereby introducing a moment into the manual wrench, which moment acts as a lateral force on the lever which is thus required between the point of attachment of the support of the articulated joint and the torque-limited shaft. Said effects are excluded from the manual wrench shown so that, once set, the shutoff torque of torque limiter 5 is reliable and can be maintained with great uniformity so that overall very precise screwing operations may be obtained.

In the embodiment presented, the torque-limited shaft is simultaneously the output shaft 4 of the manual wrench. The positive effects described still remain in the event an interposed gear means is used between the actual output shaft and the shaft for which the torque is to be limited, which shaft coincides with the pivot axis of support 15.

For example, if a flat output means were used, the bolt axis would not coincide, as in the embodiment shown, with the pivot axis of support 15. Nevertheless, the torque-limited axis, i.e. an output shaft serving as a drive shaft for the flat output means, would coincide with this pivot axis of support 15 so that the advantages described remain intact.

In the case of a slight variation of the embodiment shown, for example, a minimal offset between the pivot axis of support 15 and the torque-limited shaft such as the output shaft 4 shown, the aforementioned advantages are still present in only slightly reduced form since the leverage or lateral forces introduced by the user into the tool affect the shutoff torque of torque limiter 5 to increasingly smaller degrees, the smaller the distance is between the two axes mentioned.

In a variation of the embodiment shown, housing 3 may surround torque limiter 5 so that only setscrew 6 and an operating grip for the change-over switch 7 are visible to the user outside housing 3.

Head 1 is fastened by an adapter 12 to shaft 2: Adapter 12 has a housing 14 which has both a connection means for the output shaft of the rod-type wrench and a connection means for the drive shaft of head 1. By using different adapters, head 1 may be used on different types of manual wrenches; and conversely, a multiplicity of differently designed heads may be used on the shaft 2 shown by using appropriate adapters.

According to the invention, certain conventional displays and alarms (not shown) may be utilized in combination with the wrench of the instant invention to be activated upon attaining a specified target tightening torque. The use and arrangement of these displays and alarms in handheld tools are conventionally known to be simple, functionally reliable, and inexpensive. For example, a display can be mechanically activated in a conventional manner, e.g., by an axially movable pin, a pivotably movably mounted bar, etc. Additionally or alternatively, an electrical sensor can be utilized in a conventional manner to generate a signal when the specified target torque is obtained. Signals from the electronic sensor are evaluated in a known manner by an electronic circuit in order to trigger conventional acoustic or optical devices when the target torque is obtained. The mechanical or electrical visual or acoustic display may be conventionally located in head 1 of the manual wrench, which would advantageously locate these displays in an optical and visual range of the user in a known manner.

Further, the wrench handle can be a conventional tubular housing accommodating a motor 28 and an output shaft 29 of the motor in a known manner. Optionally, the motor can be coupled in a conventional manner to a wireless power supply. Housing can be designed with high bending strength, which bending strength during manipulation of the wrench allows for the transmission of considerably higher tightening torques to the output tool shaft than from the motor drive. Moreover, the rod-shaped tubular housing can include a conventional grip area for manual actuation of the wrench.

What is claimed is:

1. Motor-driven manual wrench comprising: a driving motor;

a head having an output tool shaft for coupling to a driving tool;

a ratchet drive located in the head;

a first torque limiter coupled to the ratchet drive;

a second torque limiter coupled to the drive motor such that the wrench forms a manually operable torque wrench whose transmittable torque is determined by the first torque limiter; and a handle, coupled to said head, being structured and arranged to manually drive the ratchet drive and structured to house the driving motor.

2. The motor-driven manual wrench according to claim 1, wherein the head is removably coupled to the drive motor.

3. The motor-driven manual wrench according to claim 1, further comprising an adapter which is connected to a drive shaft of the head and to an output shaft of the motor.

4. The motor-driven manual wrench according to claim 1, wherein the head is designed as an angle head having said output tool shaft offset relative to a drive shaft of the head.

5. The motor-driven manual wrench according to claim 1, wherein the first torque limiter is designed to be adjustable such that the transmittable tightening torque is adjustable to specified values.

6. The motor-driven manual wrench according to claim 1, wherein the first torque limiter comprises an articulated joint in which an articulated body is positioned between a first support and a second support, said second support being pivotably mounted for rotation around a pivot axis located at a distance from the articulated body, and said first support being positioned to rotate the second support body, whereby a limitable torque is applied to the output tool shaft.

7. The motor-driven manual wrench according to claim 1, further comprising a visual display which is activatable when a specified tightening torque is obtained.

8. The motor-driven manual wrench according to claim 7, wherein the display is mechanically activatable.

9. The motor-driven manual wrench according to claim 1, further comprising an electrical sensor which generates a signal when a specified tightening torque is obtained.

10. The motor-driven manual wrench according to claim 9, further comprising an electronic circuit which is effectively connected to the sensor, the circuit activating at least one of an acoustic signal and a visual display when the predetermined number of driving operations implemented with a specific tightening torque is obtained.

11. The motor-driven manual wrench according to claim 9, wherein an electronic circuit activates at least one of an acoustic signal and a visual display when a signal is received from the sensor.

12. The motor-driven manual wrench according to claim 8, wherein the display is located at the head.

13. The motor-driven manual wrench according to claim 1, wherein the wrench is configured as an elongate rod-type wrench.

14. The motor-driven manual wrench according to claim 1, further comprising a wireless power supply for the motor.

15. The motor-driven manual wrench according to claim 1, wherein the handle comprises a tubular housing accommodating the motor and an output shaft of the motor, said housing is designed with high bending strength, which bending strength during manipulation of the wrench allows for the transmission of considerably higher tightening torques to the output tool shaft than from the motor drive, with the tubular housing having a grip area for manual actuation of the wrench.

16. The motor-driven manual wrench according to claim 15, wherein the housing is formed of metal.

17. The motor-driven manual wrench according to claim 16, wherein the metal is light metal.

18. The motor-driven manual wrench according to claim 6, wherein said first and second supports are structured and arranged for movement relative to each other when the torque transmitted to the output tool shaft exceeds a limit of the limitable torque.

19. The motor-driven manual wrench according to claim 18, wherein the relative movement between body said first and second supports is an articulating motion occurring at said articulated body.

20. A torque wrench comprising, a ratchet drive;

a motor drive;

a shaft arranged to be driven by said ratchet drive and said motor drive;

a handle structured to house the motor drive; and a first torque limiter coupled to said ratchet drive and a second torque limiter coupled to said motor drive, wherein a torque limit of said first torque limiter is set to be greater than a torque limit of said second torque limiter.

* * * * *